United States Patent [19]

Bower et al.

[11] 4,371,366

[45] Feb. 1, 1983

[54] METHOD FOR MAKING A PRODUCE TRAY

[75] Inventors: Thomas E. Bower, Long Beach, Calif.; John J. Aust, Toledo, Ohio

[73] Assignee: Owens-Illinois, Inc., Toledo, Ohio

[21] Appl. No.: 219,005

[22] Filed: Dec. 22, 1980

[51] Int. Cl.[3] ..... B65P 5/36

[52] U.S. Cl. ..... 493/138; 493/90; 493/912; 229/27; 229/34 HW; 229/41 R

[58] Field of Search ..... 229/27, 34 HW, DIG. 11, 229/DIG. 6, 52 AW, 52 AM, 32, 34 R, 35, 15, 16 C, 41 B, 41 R, 10, 30; 206/183, 184, 185, 186, 188, 190, 434; 493/136, 137, 138, 92, 90, 140

[56] References Cited

U.S. PATENT DOCUMENTS

| | | | |
|---|---|---|---|
| 2,593,895 | 4/1952 | Kohl | 229/27 |
| 2,679,970 | 6/1954 | Saidel | 229/27 |
| 2,903,176 | 9/1959 | Crane | 229/27 |
| 2,990,995 | 7/1961 | Wessel | 229/52 AW |
| 3,055,572 | 9/1962 | Crane | 229/27 |
| 3,074,615 | 1/1963 | Johnson | 229/34 HW |
| 3,100,595 | 8/1963 | Curtiss et al. | 229/27 |
| 3,395,791 | 8/1968 | Graser | 206/434 |
| 4,058,249 | 11/1977 | Buck | 229/34 HW |
| 4,292,034 | 9/1981 | Probyn et al. | 493/92 |

FOREIGN PATENT DOCUMENTS

| | | | |
|---|---|---|---|
| 466863 | 11/1951 | Italy | 229/27 |

*Primary Examiner*—William Price
*Assistant Examiner*—Gary E. Elkins
*Attorney, Agent, or Firm*—John R. Nelson; Myron E. Click; David H. Wilson

[57] ABSTRACT

This invention provides an easily erected tray structure for produce and the like, featuring construction from a single corrugated blank which is preglued and folded in a flat configuration, and which incorporates at its opposite ends and intermediate thereof interlocking projections providing improved stackability and improved structural integrity during shipment and display usage. A method for producing the tray includes prefolding a blank into a flat configuration and pregluing pairs of panels together, prior to final erection of the box.

3 Claims, 10 Drawing Figures

METHOD FOR MAKING A PRODUCE TRAY

BACKGROUND OF THE INVENTION

1. Field of the Invention

This invention relates to a produce container, and more particularly, a stackable open-top tray structure for berries and the like formed from a foldable blank constituted of corrugated paperboard or related materials.

2. Description of the Prior Art

It is known in the art to which this invention pertains to provide a container formed of a single blank having a varied number of panels with flaps attached at opposite ends to form a split reinforced bottom section connected with a single top panel providing access into the bottom sections. Dual compartment, open top trays having upwardly extending tabs at opposite ends are also known, and it has also been proposed to utilize at opposite ends of a corrugated crate or tray, vertically retractable handle members.

In particular U.S. Pat. No. 3,100,595 to Curtiss et al. describes a box for produce having multilayer walls, all formed from a single folded sheet of corrugated board. The Curtiss box has two compartments separated by a multilayer divide panel. It does not, however, provide any means of retaining a handle, nor means for stabilizing the bottom wall which comprises two wall sections joined at a seam, nor means for stabilizing a stack of boxes.

In the prior art structures, there has not been manifested the provision of a container formed from a single sheet of paperboard material, pre-glued for ease of erection, utilizing a single central wire handle which facilitates container stacking, and also having upwardly extending tabs to improve stackability, and horizontal tabs which bridge the bottom center to add stability to the container.

SUMMARY OF THE INVENTION

This invention is directed to an open top divided corrugated container particularly well adapted for transport and display of merchandise or produce exemplified by various types of melons, berries and the like. The open top container or tray of this invention is formed from a single blank of fiberboard, corrugated paperboard or like paper product having a precisely apertured center section transversely and longitudinally scored or indented and connecting at opposite ends through configured score lines with lengthwise and crosswise indented and scalloped end sections. Alternatively, the mentioned center section of the blank may be configured to provide end sections and the stated end sections can make up the center portion of the erected box. In either arrangement, by suitably folding the blank, there is provided a container or tray presenting upwardly protruding lip or tab portions for improved support and stability. In one embodiment, the container has a central portion with means for reception of a handle, which markedly adds to rigidity of the container.

Initial steps in folding and glueing the blank prior to erection of the box may be performed in accordance with this invention by the manufacturer before shipping to a customer who will finally erect the box. In such case, the blank is folded transversly at approximately one quarter length from each end. The two end edges are then brought into abutment and the two panels adjacent such edges are respectively glued to adjacent central panels. The flat configuration thus formed is convenient for shipping, and comprises two pairs of panels glued together which will form a quadruple layer central dividing panel when the box is erected.

DESCRIPTION OF THE PREFERRED EMBODIMENT

Figure 1:
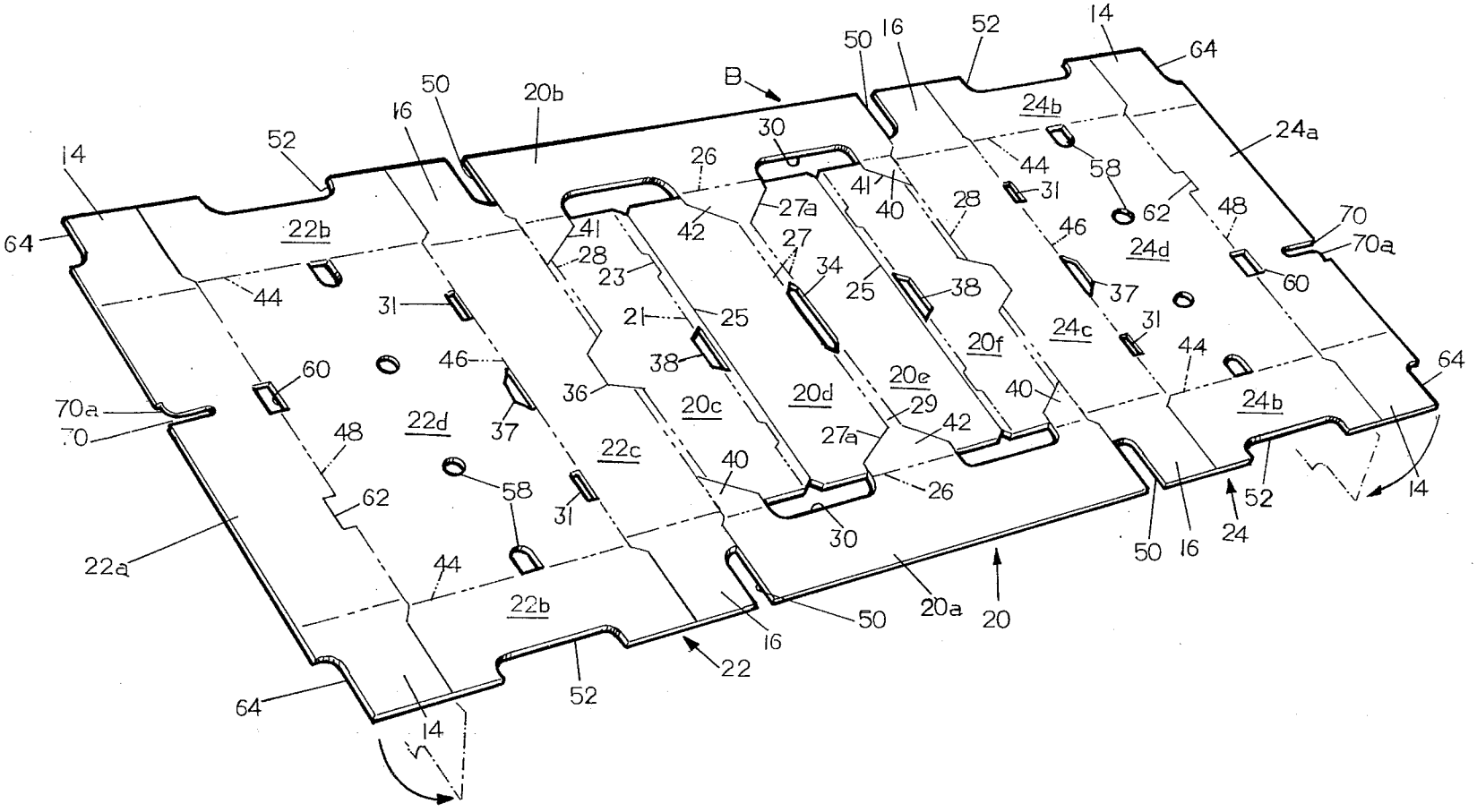
FIG. 1 is a perspective view of a box blank cut and scored in accordance with the novel concepts of this invention.

Referring now to the drawings, and specifically to FIG. 1, a box embodying this invention is erected from a flat blank B of corrugated paperboard or like paper product, which comprises a central section 20 and integral end sections 22 and 24. Central section 20 is defined by score lines 28, perpendicular to and extending between the longer edges of rectangular blank B. Central section 20 is divided by score lines 26 parallel to the long edges of blank B which define end panels **20*a* and 20*b*. Score lines 26 are not continuous, but are interrupted by scalloped cutouts 30. Parallel to and midway between score lines 28, is a pair of closely spaced score lines 27, defining a central rib 29 between them. The end portions 27*a* of score lines 27 are flared outwardly from each other as they approach score line 26. The central rib 29 is therefore widened to form triangular sections 42 where rib 29 is connected to panels 20*a* and 20*b*. Flared lines 27*a*** are not merely scored, but are cut.

Figure 7:
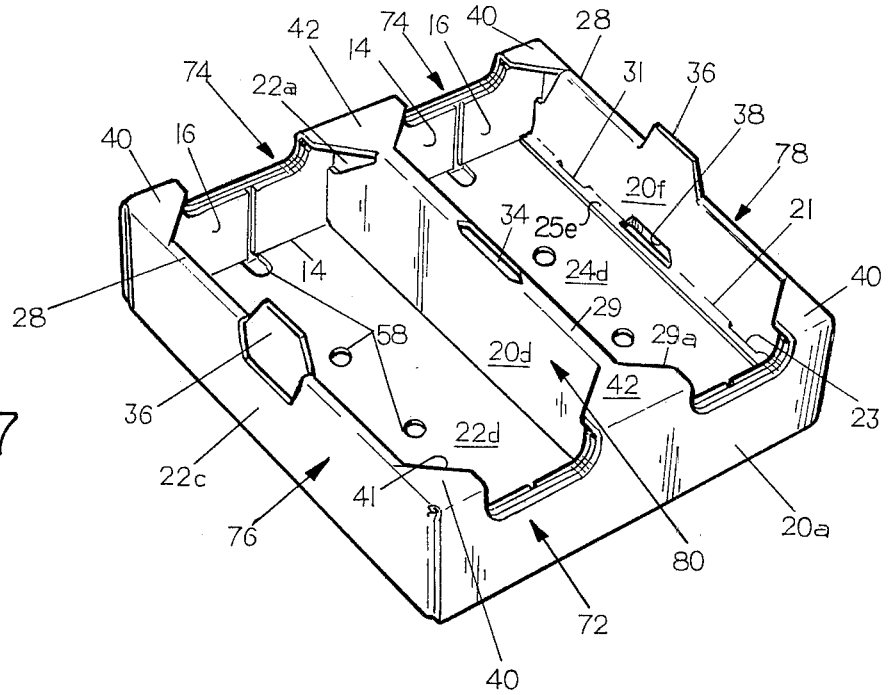

Central section 20 is further divided into four wall panels by two cut lines 25 which are parallel to and midway between lines 27 and 28. Score lines 27 and 28, and cut lines 25 divide central section 20 into four generally equal panels **20*c*, 20*d*, 20*e*, 20*f*. Central panels 20*d* and 20*e* are defined by cut lines 25 and 27*a*, and cut outs 30, and are hingedly connected on score lines 27 to central rib 29. When folded downward on score lines 27 during erection of the box, panels 20*d* 20*e* will form walls of a central tray divider 80 (FIG. 7). Panels 20*c* and 20*f* are defined by cut lines 25 and 41 and holes 30 and are hingedly connected at score lines 28. When folded downwardly on score lines 28 during erection of the box, they will form inner layers of double layer side walls 76 and 78 (FIG. 7). Lines 41, 28, and 26 define triangular sections 40** which brace the corners of the erected box.

Side wall panels **20*c* and 20*f* have a scored and partially cut line 21 parallel to and slightly spaced from cut lines 25 which defines edges of panels 20*c* and 20*f*. Score line 21 deviates from a straight line and is cut to define tabs 33. The distance from lines 28 to line 21 is equal to the inside height of the side wall of the erected box. When erected, therefore, side wall panels 20*c* and 20*f* are folded on lines 21** against the bottom wall of the box.

The folded edge 25*e* between fold line 21 and cut line 25 of each of the panels 20*c* and 20*f* lie inside the box and abutt the bottom 22*d*, as shown on FIG. 7. Tabs 23 extend downward through slots 31 in position.

Score line 28 is cut where it defines a trapezoidal tab 36. When the box is erected, tabs 36 will form upward extensions of side wall panels 26*c* and 20*f*. When boxes are stacked, the engagement of tabs 36 and holes 37 and 38 on the bottom walls of boxes will give stability to the stack.

Blank end sections 22 and 24 are essentially identical in structure and accordingly like numerals are employed to designate like structural features. Each section 22 and 24 is longitudinally scored on two parallel score lines 44, to define half width end panels 22*b* and 24*b*. There is further provided in each section a pair of transversely extending score lines 46 and 48 which intersect the longitudinal fold lines 44. Score lines 48 and the adjacent blank end edge define between them divider panels 22*a* and 24*a*, which will cooperate with central panels 20*d* and 20*e* to form a central tray divider when the box is erected. Each divider panel 22*a* and 24*a* is provided with ¼ width end flaps 14 at its ends. Scorelines 46 and 28 define between them side wall panels 22*c* and 24*c* which will cooperate with central panels 20*c* and 20*f* to form double layer side walls when the box is erected. Each side wall panel 22*c*, 24*c* is provided with ¼ width end flaps 16 at its ends. Score lines 44, 48 and 46 on each end section 22 and 24 define generally rectangular bottom panels 22*d* and 24*d*.

The edges of end panels 22*b* and 24*b* have cut-out scallops 52. Corresponding openings 50 and 64 are formed on each end flap, which will be aligned with cut-outs 52 and 30 when the box is erected.

In each end section 22 and 24, each transverse score line 48 deviates from a straight line to define a rectangular stabilizing tab 62. Each transverse score line 48 is also interrupted by a rectangular hole 60. The hole 60 of each end section 22 and 24 is opposite the corresponding tab 62 on the other end section. When the box is erected, tabs 62 will bridge the tray bottom seam to engage holes 60, and will therefore give additional stability to the box.

The extreme edges of sections 22 and 24 are cut out to form handle retaining holes 70. Central rib 29 is also provided with a slot 34 to receive a handle. In addition, a plurality of ventilation holes 58 are formed in end sections 22 and 24.

Figure 2:
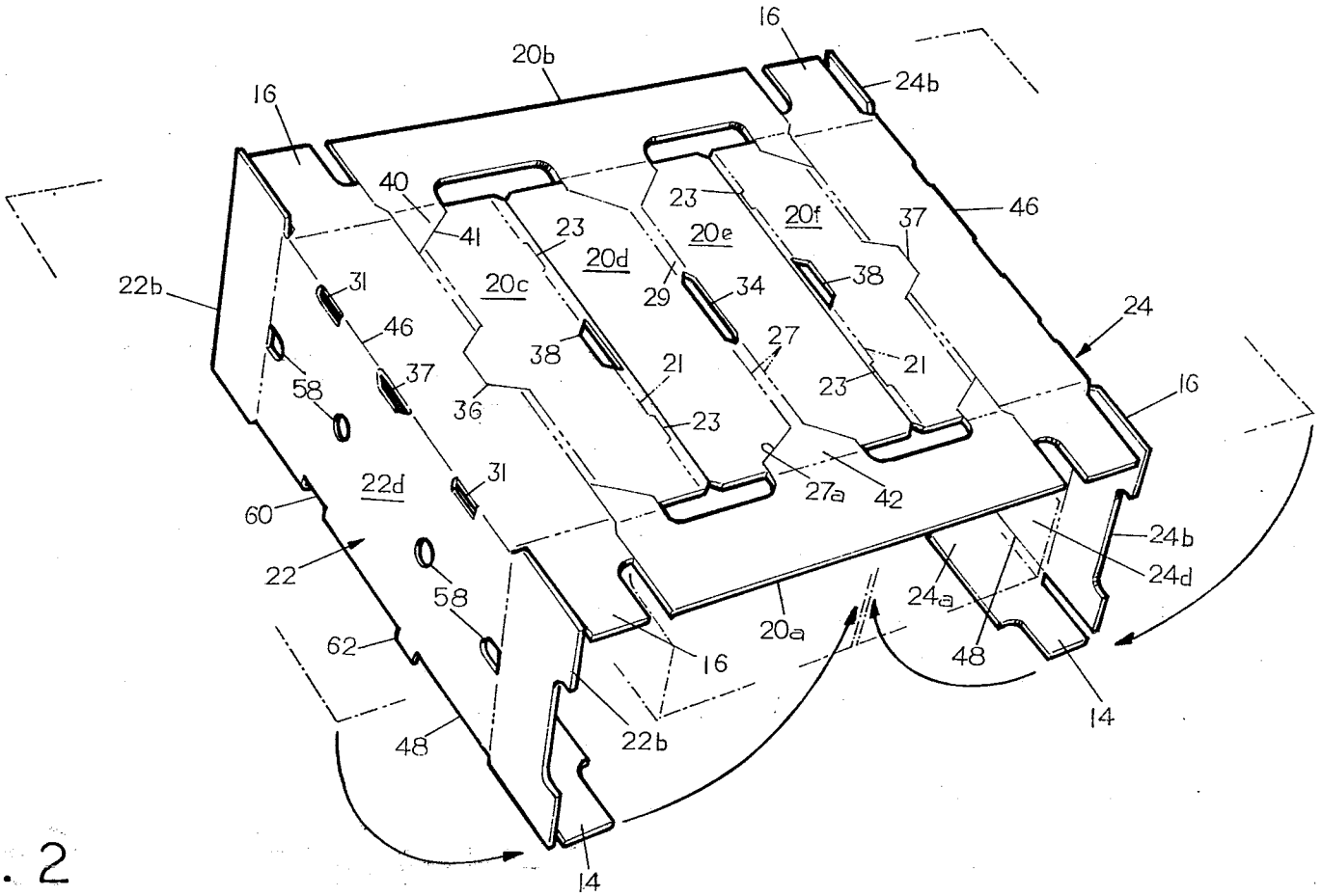
FIGS. 2 through 7 are perspective views illustrating successive steps in folding and erection of the instant container.
Figure 3:
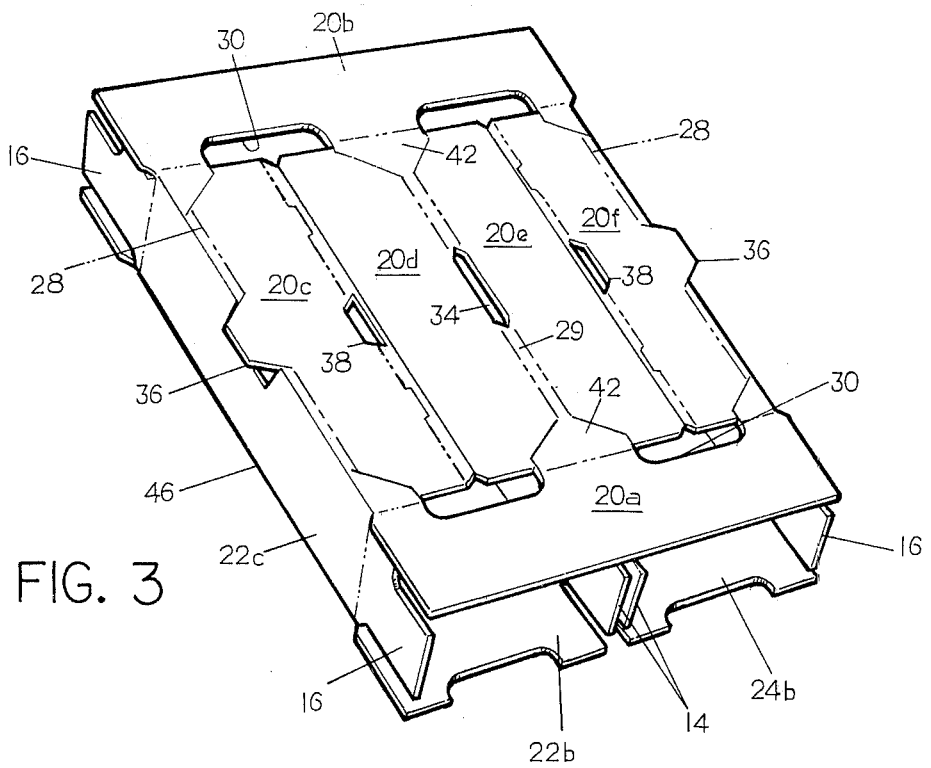

Steps in folding of the blank B of FIG. 1 to produce the container of FIG. 7 will now be described with reference to FIGS. 1–7. However, it is to be understood that variations may be practiced in the sequence of the assembly procedure without departing from the novel concepts of this invention. A first step is to fold end sections 22*a* and 24*a* downwardly and inwardly on score lines 48 as indicated by the arrows of FIG. 1. Next, sections 22 and 24 are folded downwardly on score lines 46 and 28 as illustrated in FIGS. 2 and 3. Sections 22*a* and 24*a* may be glued or stapled together.

Figure 4:
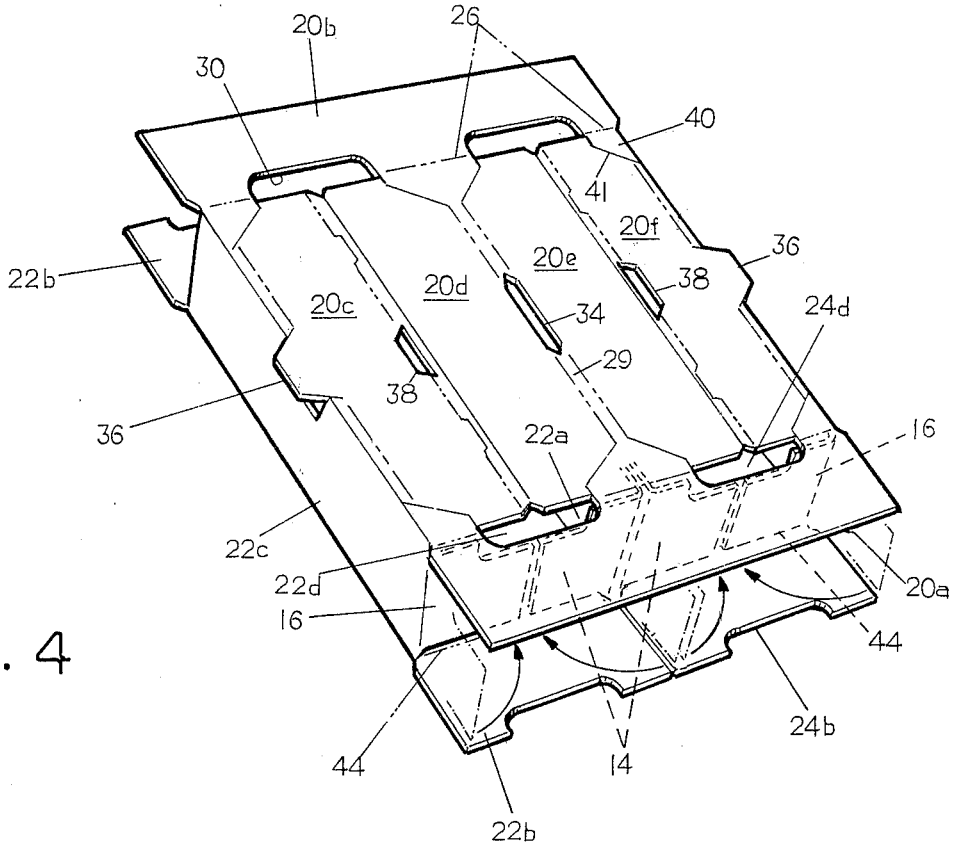
Figure 5:
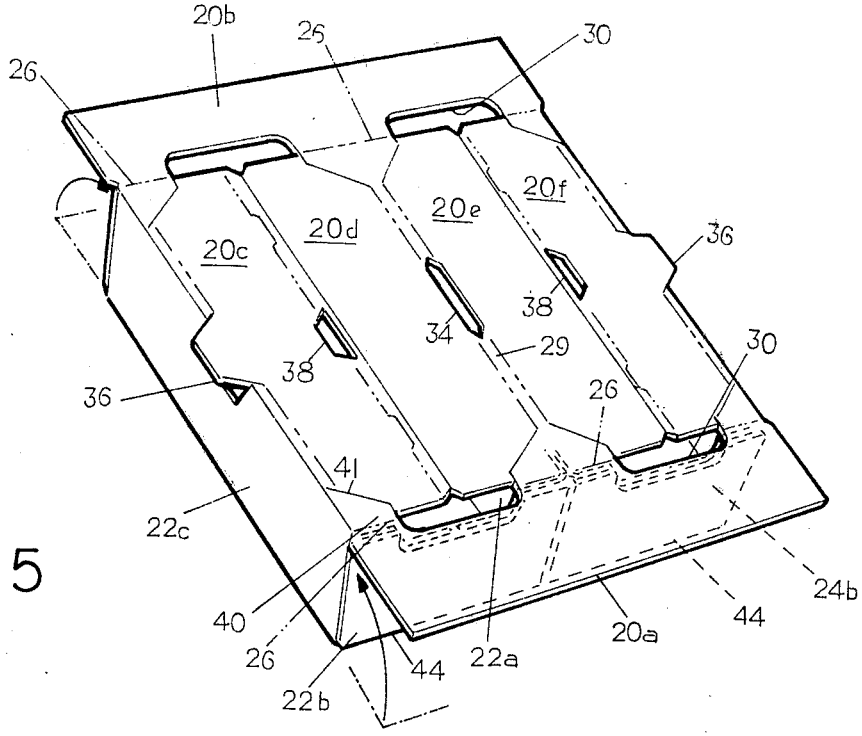

End flaps 14 and 16 are folded inwardly at both ends of the tray to cover the open ends of the partially formed trays (FIGS. 4 and 5). Half width end panels 22*b* and 24*b* are then folded upward onto flaps 14, 16 and full width panels 20*a* and 20*b* are folded downward onto panels 22*b* and 25*b*, thereby forming both end walls of the tray with each comprising three layers of corrugated board. These three layers are glued or stapled together to form an integral end wall supporting the two central tray sections (FIGS. 5 and 6).

Figure 6:
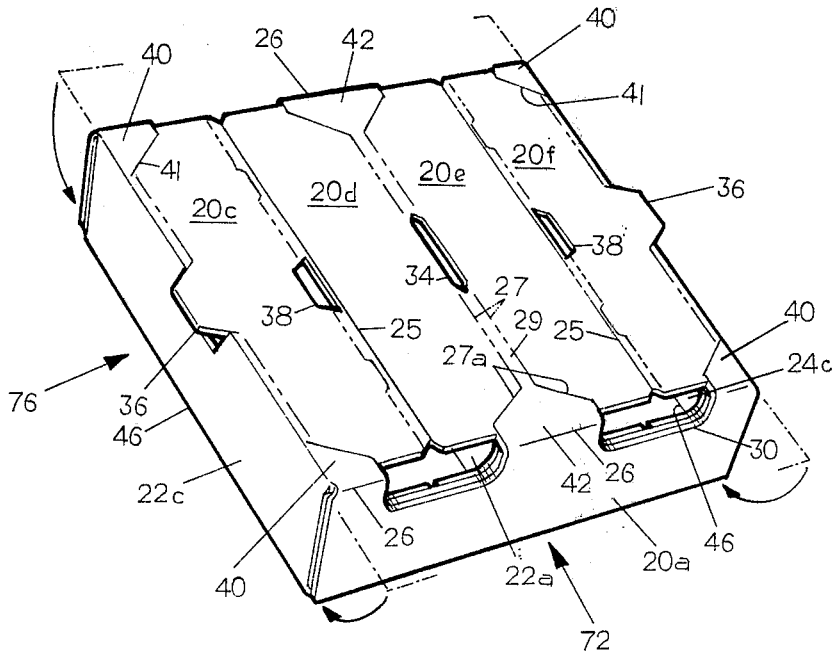

After the forming of the end walls as shown in FIG. 6, central panels 20*c*, 20*d*, 20*e* and 20*f* are separated along cut lines 25. Panels 20*d* and 20*e* are folded downward on score lines 27 into flush abutment with sections 22*a* and 24*b*, to form a four layer tray divider 80 (FIG. 7). Panels 20*c* and 20*f* are folded inwardly and downwardly on score lines 28 into flush abutment with sections 22*c* and 24*c* to form double layer side walls 76 and 78.

Figure 8:
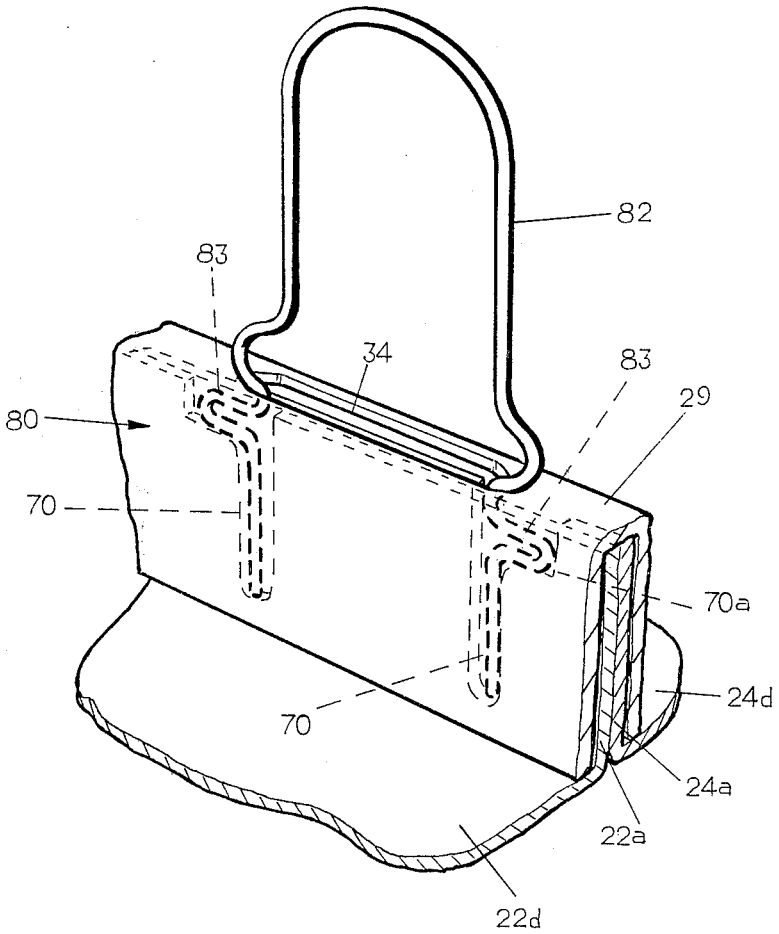
FIG. 8 is a perspective view of an illustrative tray handle structure with a portion of the produce tray shown cut away for clarity.

Means for retaining a wire handle 82 are provided on the central divider panel 80 as illustrated in FIG. 8. Divider panel 80 has a top slot 34 formed in central rib 29. Slots 70 formed in panels 22*a* and 24*a* form holes extending downward from the slot 34. A wire handle 82 is generally U-shaped having its free ends spaced for insertion into slot 34 and vertical holes 70. The legs of the U-shaped handle have outwardly bent projections 83, which extend outward a greater distance than the length of the slot 34. Therefore, to insert the wire handle 82, it must be squeezed to allow the projections 83 to fit through slot 34. When this squeezing pressure is released, the sides of U-shaped handle 32 expand, moving projections 83 beyond slot 34 and underneath central rib 29. Holes 70 have horizontally curved extensions 70*a* formed to receive the projections 83 as they expand outward. When the handle 82 is thus in position, the engagement of projections 83 and the inside surface of central rib 29 allows the box to be lifted by the handle 82.

Figure 10:
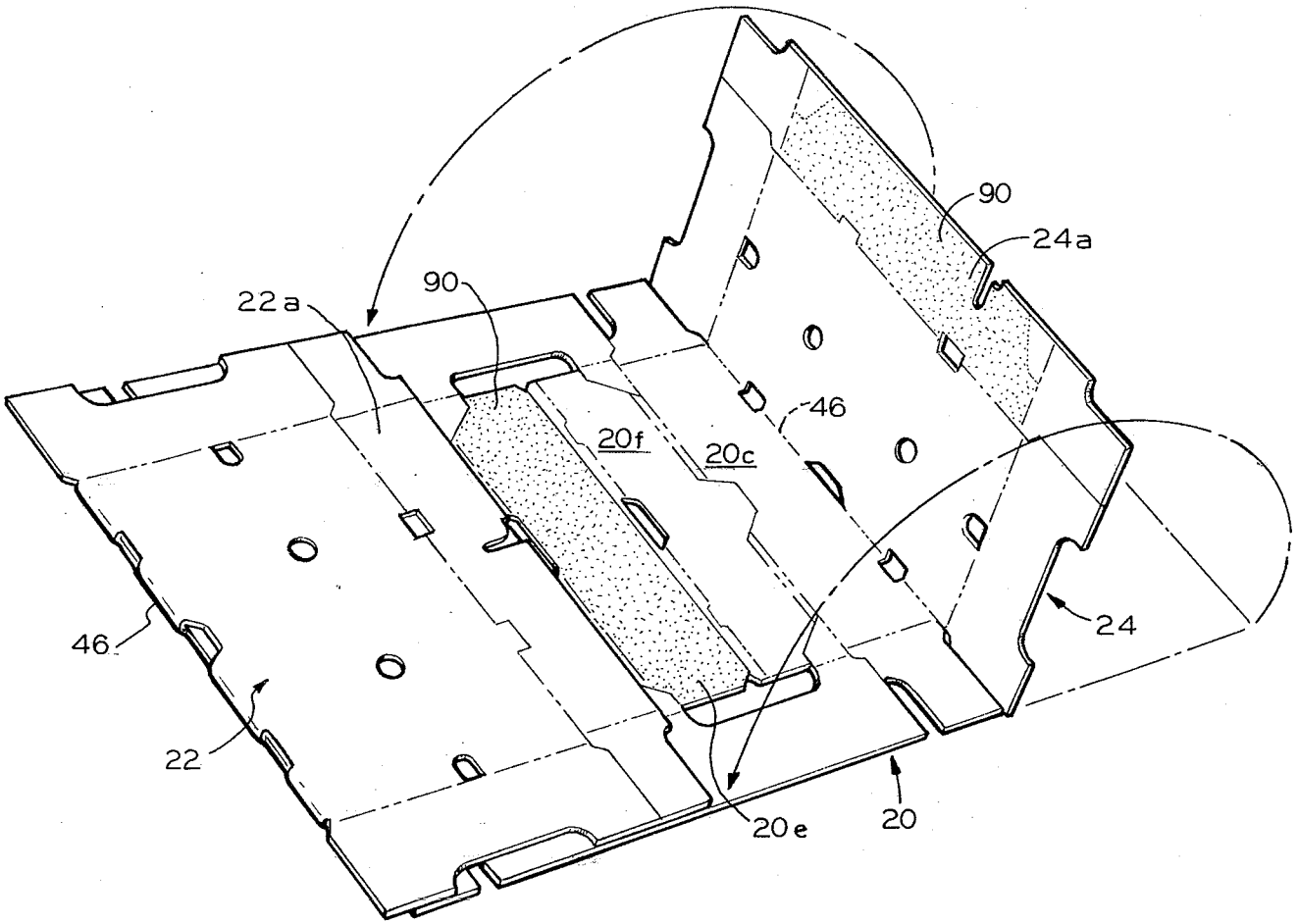
FIG. 10 is a perspective view of the box blank of FIG. 1 illustrating an alternative method of folding and preglueing before final erection.

An alternate method of erection may be conveniently employed if the blank is preglued by the manufacturer or before final erection. The blank is first folded on lines 46. Panels 20*d* and 22*a*, which form two layers of tray divider 80, and panels 20*e* and 24*a*, which form another two layers of tray divider 80, are respectively glued together by the manufacturer of the corrugated blank. As shown, with reference to FIG. 10, the blank of FIG. 1 has a layer 90 or spots of adhesive applied to either of the facing surfaces of dividers 24*a* and central panels 20*e* (or both) and similarly adhesive applied to either of the facing surfaces of divider panel 22*a* central panel 20*d* (or both). The end panel 24 is next folded inwardly along the fold line 46 so that panels 24*a* and 20*e* are adhesively secured togehter. Likewise, the other end panel 22 is folded inwardly on its line 46 and panels 22*a* and 20*d* are adhesively secured together. In this flat configuration the blank may easily be shipped to a customer for final erection and use. Erection of the side walls automatically pulls the divider panels 20*d* and 20*e* into place. Completion of the box may then proceed as already described.

If the box is erected according to this last alternate method, panels 22*a* and 24*a* which form the interior layers of the four layer divide panel 80 need not be glued together. The slot between the two abutting faces of the panels 22*a* and 24*a* can therefore receive the top portion of a handle 82 of another box disposed below the stack. The fit of a handle 82 within a divider panel 80 will further stabilize a stack of boxes.

Therefore, as illustrated in FIG. 7, the erected box comprises double layer side walls 76 and 78, triple layer end walls 72 with 74, and a quadruple layer central rib tray divider 80. Rib 29 forms the top surface of divider 80 and is braced at its connection to end walls 72 and 74 by triangular sections 42.

Figure 9:
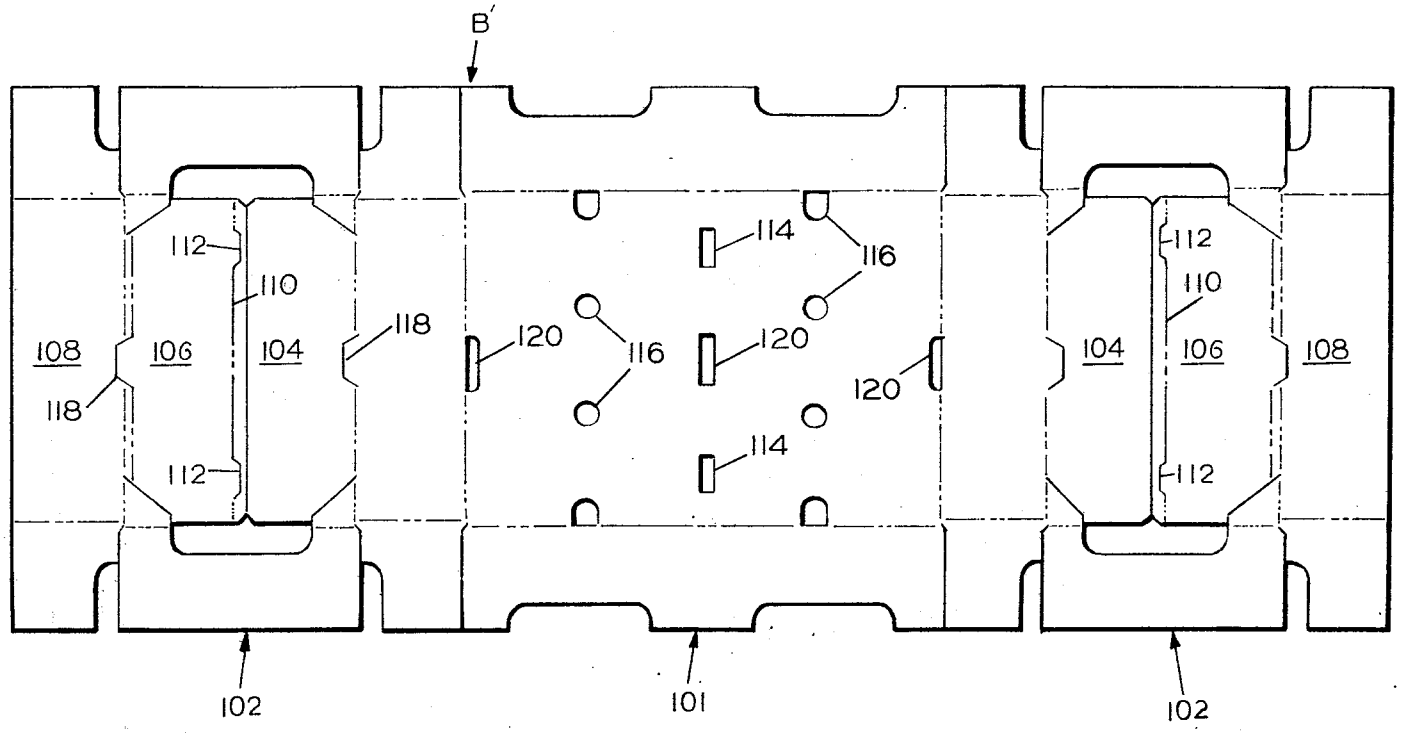
FIG. 9 is a top plan view of an alternative form of box blank.

In an alternative embodiment, a box may be formed from the blank B′ illustrated in FIG. 9. The central section 101 forms a continuous bottom wall of the erected box, unlike the bottom wall of the box described above, which had a seam below the central divider 80. End sections 102 of the blank B′ form the top wall of the erected box, and thus together correspond to the central section 20 of the blank B. Panel sections 104 correspond to panel sections 20*c* and 20*f* of the blank B, and each forms a layer of a double layer side wall of the box erected from the blank B′. Panel sections 106 correspond in function to panels 20*d* and 20*e* and form two layers of a four layer central divider panel. End panels 108 cooperate with panels 106, and comprise the two interior layers of a four layer central divider panel of a box erected from the blank B′.

In erecting the box from blank B′, the panels 108 are brought into flush abutment perpendicular to and above the central portion 101, in the same manner as end sections 22*a* and 24*a* were brought together below the central rib 29 of the blank B, as shown in FIG. 3. Central panels and end panels are then folded into place and secured in a manner similar to that described for the erection of a box from blank B.

Panels 106 have fold lines 110 including cut out tabs 112 provided on the edges of the panels 106. The configuration of fold lines 110 and tabs 112 corresponds to the fold lines 21 and tabs 23, respectively. When the panels 106 are folded downwardly to form layers of the four layer divider panel, the tabs 112 fit into holes 114 formed in the bottom wall 101, thereby bracing the panels 106 snugly against the bottom wall 101.

Other features of the alternate blank B′ similar to blank B are ventilation holes 116, stacking tabs 118 and corresponding holes 120.

In view of the disclosure, further modifications of the invention will be apparent to those skilled in the art, and it is intended that the scope of the invention be determined solely by the appended claims.

What is claimed is:

1. A method for forming a one piece two-tray open top container for produce and the like from a single layer rectangular blank of corrugated board, including the steps of:

dividing the rectangular blank by two transverse fold lines into a central section extending one half the length of the rectangular blank and having four transversely extending central panels, and two end sections each extending approximately one quarter of the length of the blank and each including one transversely extending end panel;

folding the end sections on such fold lines into flat abutting relationship with the central section, thereby bringing the terminal edges of the end sections into parallel proximity adjacent the center of the central section, and bringing each end panel into surface abutting relationship with one of said central panels;

glueing each of said end panels to the abutting central panel; and folding the two glued pairs of said end panels and said central panels into surface abutting relationship, thereby forming a quadruple layer central divider panel extending between said central section and said end sections with said central and end sections respectively forming a top wall and a bottom wall of the container.

2. The method of claim 1 in which the four central panels are divided by transverse fold lines, and folding the opposite outside central panels interiorly of the box each forming a side wall layer, the said folding forming vertical tabs on each side wall projecting from the top thereof, whereby inter-engagement of said tabs with two or more vertically stacked boxes will stabilize them in stacked relationship.

3. The method of claim 1 in which the folding of the said end panels and the two interior ones of the four central panels into surface abutting relationship provides the said central divider panel and further forms a slot at the top of said divider panel, and including inserting a handle through said slot for projecting above the top of the central divider and held by the said two interior folded central panels underneath the top surface of the central divider.

* * * * *